US011041667B2

(12) United States Patent
Yokozeki et al.

(10) Patent No.: US 11,041,667 B2
(45) Date of Patent: Jun. 22, 2021

(54) REFRIGERATION CYCLE APPARATUS

(71) Applicant: Hitachi-Johnson Controls Air Conditioning, Inc., Tokyo (JP)

(72) Inventors: Atsuhiko Yokozeki, Tokyo (JP); Koji Naito, Tokyo (JP); Kazuhito Sekiba, Tokyo (JP); Shoutaro Yamamoto, Tokyo (JP); Hiroaki Kaneko, Tokyo (JP); Kazuhiko Tani, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 193 days.

(21) Appl. No.: 16/360,189

(22) Filed: Mar. 21, 2019

(65) Prior Publication Data

US 2019/0277550 A1 Sep. 12, 2019

Related U.S. Application Data

(63) Continuation of application No. PCT/JP2018/009337, filed on Mar. 9, 2018.

(51) Int. Cl.
*F25B 49/02* (2006.01)
*F25B 41/00* (2021.01)
(Continued)

(52) U.S. Cl.
CPC ..... *F25B 49/022* (2013.01); *F25B 41/40* (2021.01); *F25B 49/02* (2013.01); *F25B 1/04* (2013.01);
(Continued)

(58) Field of Classification Search
CPC ..... F25B 49/02; F25B 49/022; F25B 41/003; F25B 1/02; F25B 13/00; F25B 2400/13;
(Continued)

(56) References Cited

U.S. PATENT DOCUMENTS 5,596,879 A * 1/1997 Burkhart ..... F04B 39/0055 415/119
6,820,434 B1 * 11/2004 Gutheim ..... F25B 1/02 62/175
(Continued)

FOREIGN PATENT DOCUMENTS

JP 2008-267707 A 11/2008
JP 2009-243880 A 10/2009
(Continued)

OTHER PUBLICATIONS

International Search Report and Written Opinion of PCT/JP2018/009337 dated May 22, 2018.

*Primary Examiner* — Marc E Norman
(74) *Attorney, Agent, or Firm* — Mattingly & Malur, PC

(57) ABSTRACT

To achieve higher efficiency at a low-load region and to enable power saving throughout a year. The refrigeration cycle apparatus 1 includes a compressor 4 that has a flow in/out port 4*d* through which a refrigerant is capable of flowing out and flowing in, in fluid communication with a compression room 4*c*; pipes 21, 22 disposed at a suction side of the compressor 4; a pipe 25 connected to the flow in/out port 4*d* of the compressor 4; a pipe 27 that has one end connected to the pipe 25 and an opposite end connected to the pipe 21; and a second solenoid valve 13 for opening and closing a fluid passage of the pipe 27.

6 Claims, 8 Drawing Sheets

(51) Int. Cl.
*F25B 41/40* (2021.01)
*F25B 1/04* (2006.01)
*F25B 13/00* (2006.01)

(52) U.S. Cl.
CPC ..... *F25B 13/00* (2013.01); *F25B 2400/13* (2013.01); *F25B 2500/12* (2013.01); *F25B 2600/2501* (2013.01); *F25B 2600/2509* (2013.01); *F25B 2600/2519* (2013.01); *F25B 2700/1931* (2013.01); *F25B 2700/1933* (2013.01)

(58) Field of Classification Search
CPC ..... F25B 2500/12; F25B 2600/2501; F25B 2600/2509; F25B 2600/2519; F25B 2700/1931; F25B 2700/1933
See application file for complete search history.

(56) References Cited

U.S. PATENT DOCUMENTS

2005/0066673 A1* 3/2005 Monk ..... F25B 31/00 62/196.3
2015/0107290 A1* 4/2015 Hatomura ..... F25B 41/00 62/324.6
2016/0018148 A1* 1/2016 Yura ..... F25B 31/002 62/192
2019/0345937 A1* 11/2019 Sato ..... F25B 41/003

FOREIGN PATENT DOCUMENTS

JP 2012-137207 A 7/2012
JP 2012-247104 A 12/2012

* cited by examiner (a)

(b)

REFRIGERATION CYCLE APPARATUS

CROSS-REFERENCE TO RELATED APPLICATION

This application is a continuation application of PCT/JP2018/009337, filed on Mar. 9, 2018, the entire contents of which are hereby incorporated by reference.

TECHNICAL FIELD

The present invention relates to a refrigeration cycle apparatus.

BACKGROUND ART

A control unit of a heat pump device controls temperature at a discharge side to a target by an expansion valve of a bypass path of an economizer circuit in order to adjust heating capacity of a load-side heat exchanger with a refrigerant flow rate flowing through the bypass path by using the expansion valve of the bypass path. (e.g., Patent Literature 1)

CITATION LIST

Patent Literature

Patent Literature 1: Japanese Patent Application Laid Open No. 2009-243880

SUMMARY OF INVENTION

Technical Problem

However, in the economizer circuit disclosed in Patent Literature 1, though enhancement of capacity can be obtained and high efficiency can be achieved in a high load region, it is difficult to achieve high efficiency at a low-load region.

Therefore, the present invention relates to a technique capable of achieving higher efficiency at a low-load region and power saving throughout a year.

Solution to Problem

To solve the aforementioned problem, a refrigeration cycle apparatus according to one embodiment of the present invention includes a compressor having a port allowing a refrigerant to flow out, in fluid communication with a compression room; a suction side pipe disposed at a suction side of the compressor; a first pipe connected to the port of the compressor; a second pipe that has one end connected to the first pipe and an opposite end connected to the suction side pipe; and a second pipe on-off valve for opening and closing a fluid passage of the second pipe.

Advantageous Effects of Invention

According to the present invention, it is possible to achieve higher efficiency at a low-load region and power saving throughout a year.

DESCRIPTION OF EMBODIMENTS

Hereinafter, a refrigeration cycle apparatus 1 according to an embodiment of the present invention will be described.

Figure 1:
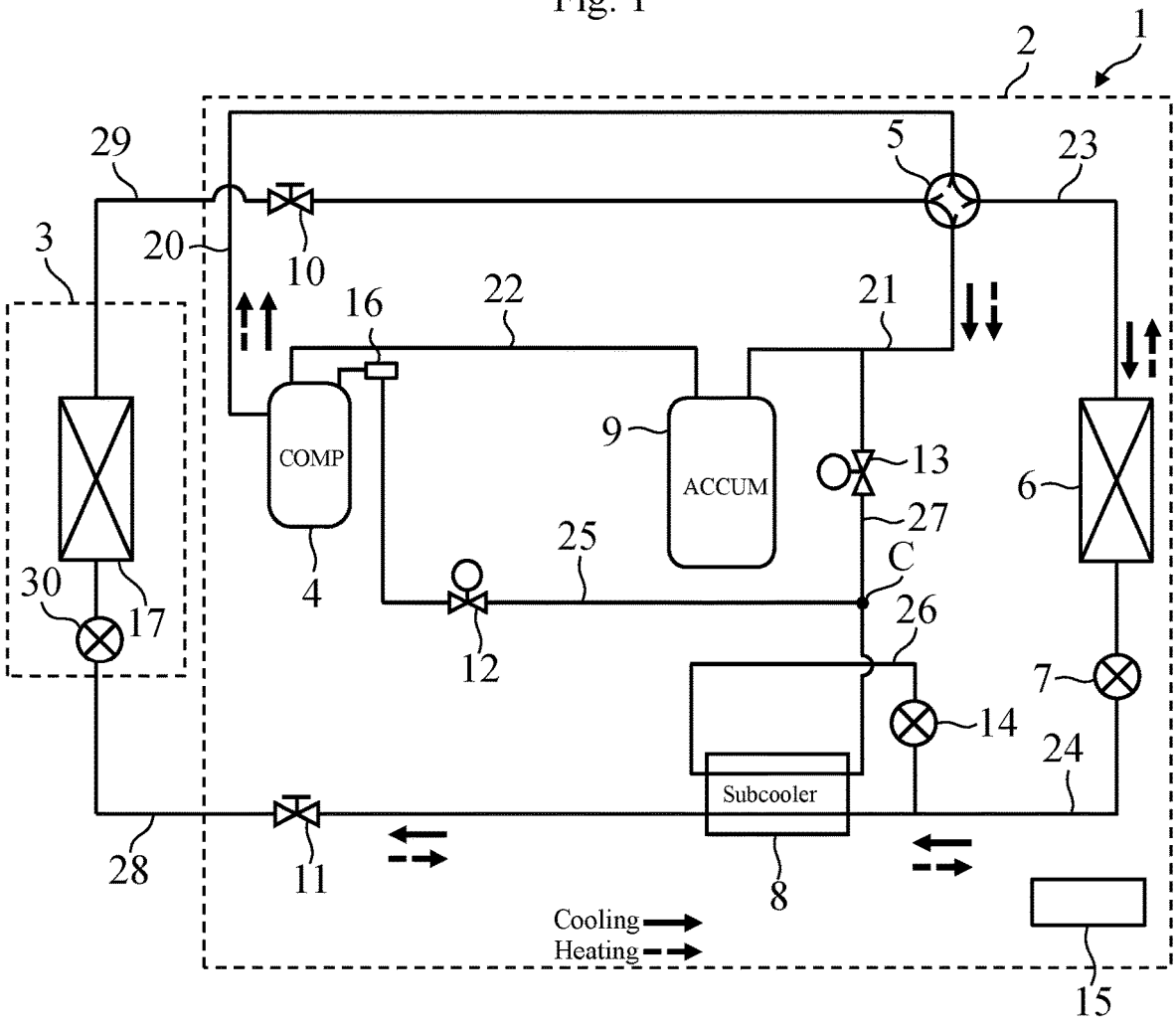
FIG. 1 shows a configuration diagram of a refrigeration cycle apparatus according to an embodiment.
Figure 2:
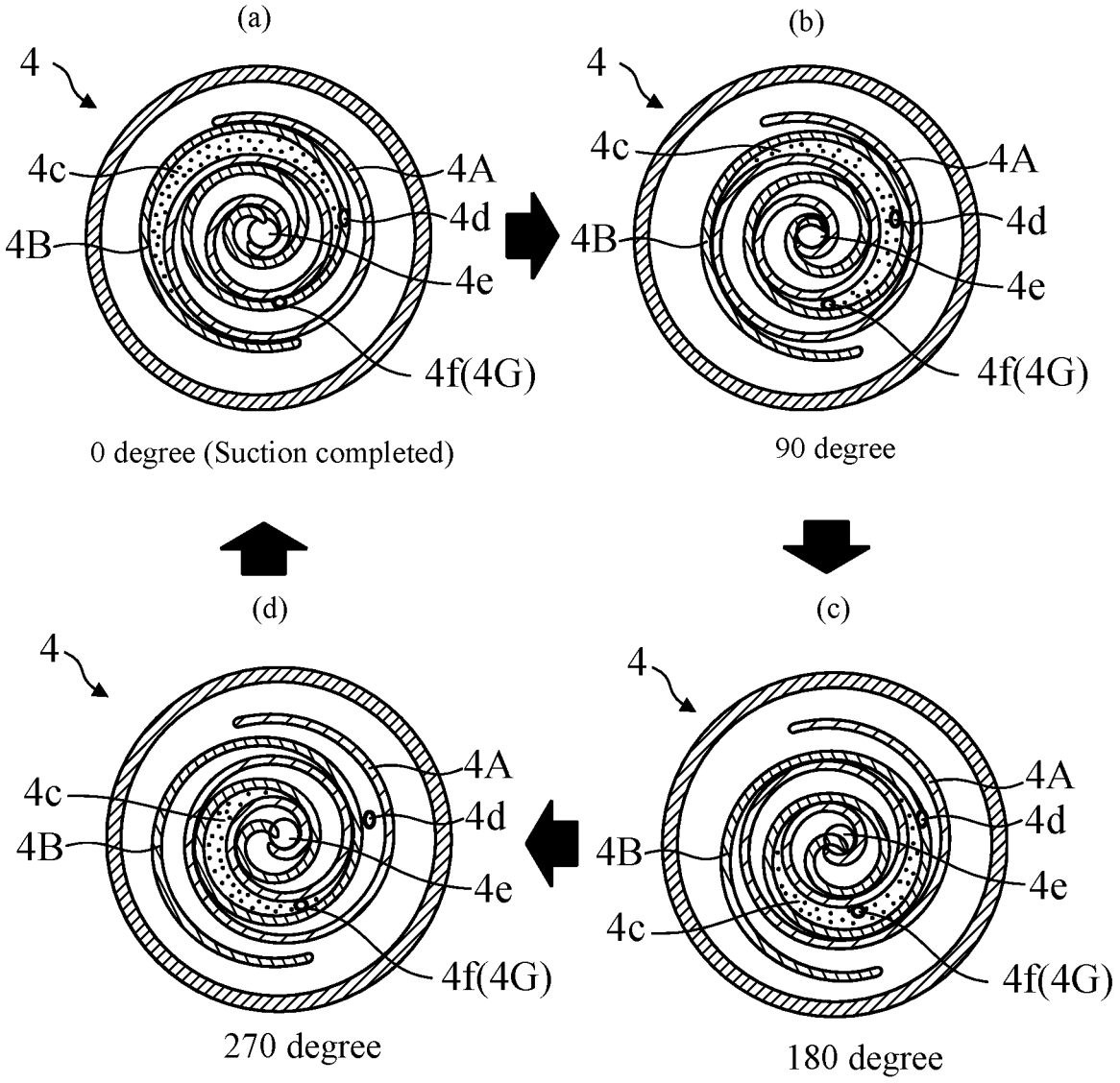
FIG. 2 describes examples of operating states of a compressor.
Figure 3:
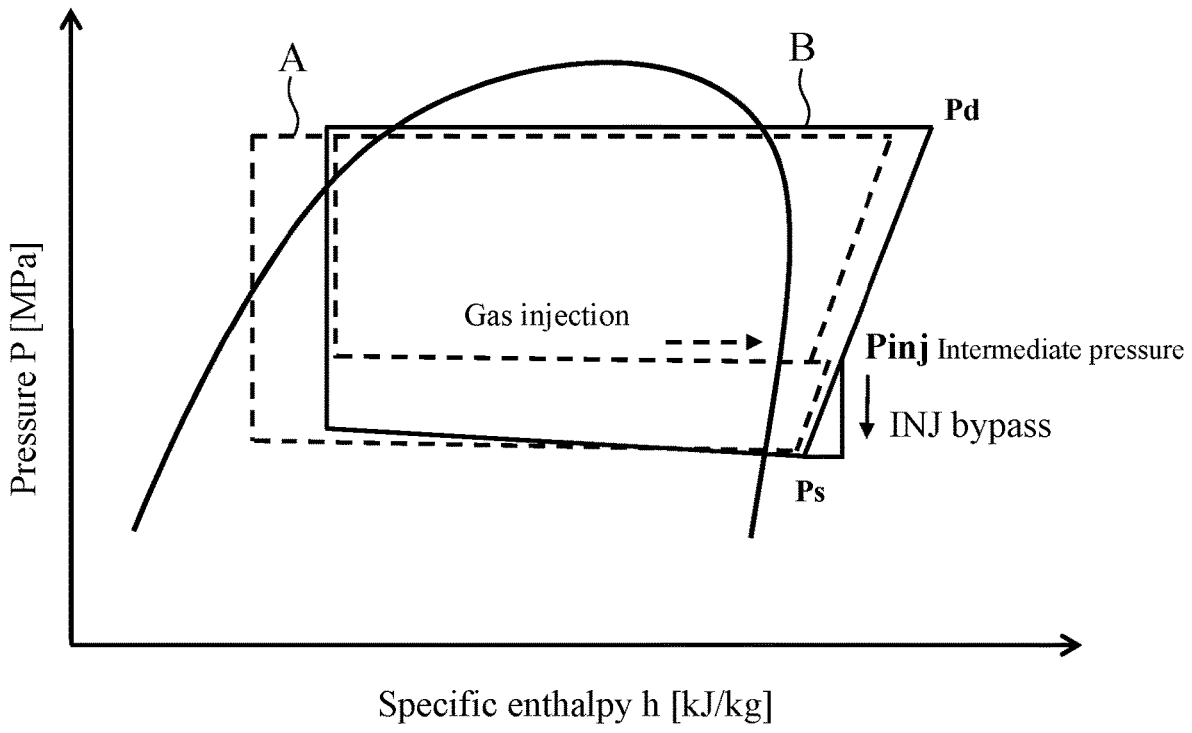
FIG. 3 shows a refrigeration cycle during gas injection and a refrigeration cycle during bypass operation on a Mollier diagram (P-h diagram).

FIG. 1 shows a configuration diagram of the refrigeration cycle apparatus 1 according to the embodiment. FIG. 2 describes examples of operating states of a compressor 4. FIG. 3 shows a refrigeration cycle during gas injection and a refrigeration cycle during bypass operation on a Mollier diagram (P-h diagram).

As shown in FIG. 1, the refrigeration cycle apparatus 1 includes an outdoor unit 2 and an indoor unit 3.

The outdoor unit 2 includes, in its casing, a compressor 4, a four-way valve 5, an outdoor heat exchanger 6, an outdoor expansion valve 7, a subcooler 8, an accumulator 9, a gas blocking valve 10, a liquid blocking valve 11, a first solenoid valve 12, a second solenoid valve 13, a bypass expansion valve 14, a controller 15, a silencer 16 and pipes 20~27.

The compressor 4 and the four-way valve 5 are connected by the pipe 20; the four-way valve 5 and the accumulator 9 are connected by the pipe 21; the accumulator 9 and the compressor 4 are connected by the pipe 22; the four-way valve 5 and the outdoor heat exchanger 6 are connected by the pipe 23; and the outdoor heat exchanger 6 and the liquid blocking valve 11 are connected by the pipe 24. The pipe 24 is equipped with the outdoor expansion valve 7. A part of the pipe 24 passes through a part of the subcooler 8. By switching the four-way valve 5, the flow of the refrigerant changes, and cooling operation and heating operation are switched.

Also, the pipe 25 is connected to the compressor 4 and a connection part C between the pipe 26 and the pipe 27. The pipe 26 is connected to the pipe 24 and the connection part C. The pipe 27 is connected to the connection part C and the pipe 21. The pipe 26 is equipped with the bypass expansion valve 14 and the part thereof passes through the subcooler 8. The pipe 25, the pipe 27 and the pipe 26 correspond to a first pipe, a second pipe and a third pipe, respectively.

The first solenoid valve 12 is disposed to the pipe 25 and opens and closes a flow passage of the first solenoid valve 12. The first solenoid valve 12 is configured to be controllable to the full open, intermediate opening degree and the like, and may have a bleed port or be configured such that a small amount of the refrigerant flows from the side of the compressor 4 to the side of the connection part C in the fully closed state. The second solenoid valve 13 is disposed to the pipe 27, and opens and closes a flow passage of the second solenoid valve 13. The bypass expansion valve 14 is disposed to the pipe 26 and depressurizes and cools the refrigerant branched from the pipe 24. The first solenoid valve 12 and the second solenoid valve 13 correspond to a first pipe on-off valve and a second pipe on-off valve, respectively. Also, the pipe 24 corresponds to a liquid pipe and the pipes 21, 22 correspond to a suction side pipe.

The controller 15 controls, based on temperature and pressure from a temperature sensor and a pressure sensor that are provided in the outdoor unit 2 not shown in the figure, rotation speed of the compressor, opening degrees of the outdoor expansion valve 7 and the bypass expansion valve 14, and opening and closing of the first solenoid valve 12 and the second solenoid valve 13.

The compressor 4 is a scroll compressor and is configured to compress the refrigerant by the compression room 4*c* formed with a fixed scroll 4A and an orbiting scroll 4B, as shown in FIGS. 2(*a*)~(*d*). The fixed scroll 4A has a flow in/out port 4*d* formed in fluid communication with the pipe 25. The flow in/out port 4*d* is formed so as to open in a position after formation of the compression room 4*c* and before discharge of the refrigerant in the compression room 4*c* from the discharge port 4*e*. The position of the flow in/out port 4*d* may preferably be a position where volume ratio of the compression room 4*c* (Vr, suction volume of the compression room 4*c* (the maximum sealed space volume of the compression room)/volume of the compression room 4*c*) satisfies $1.0<Vr\leq1.4$, and more preferably, be a position satisfying $1.0<Vr\leq1.3$.

The reason why the flow in/out port 4*d* is disposed in the position of the aforementioned volume ratio is that if the port is not disposed at a position after the suction room is closed as the minimum position, inflow is not permitted during the gas injection even when it is open, and the maximum position is to be at a theoretical pressure ratio of 1.41 or 1.56 (in the case where the refrigerant is R410A) and can be at no more than the minimum pressure ratio of an air conditioner due to an upper limit for allowing the gas injection at minimum.

Here, the flow in/out port 4*d* is configured to allow the refrigerant to flow into the compression room 4*c* or flow out from the compression room 4*c* and has no check valve.

Also to the fixed scroll 4A, a release port 4*f* is formed and the release port 4*f* is equipped with a release valve 4G for discharging the refrigerant from the compression room 4*c* to a discharge space of the compressor 4 when pressure in the compression room 4*c* becomes higher than the discharge pressure. The release port 4*f* is formed so as to open in a position where the refrigerant in the compression room becomes higher pressure than that at the position where the flow in/out port 4*d* is formed.

The indoor unit 3 includes, in its casing, an indoor heat exchanger 17 and an indoor expansion valve 30. The outdoor unit 2 and the indoor unit 3 are connected each other by a liquid connection pipe 28 and a gas connection pipe 29.

The controller 15 of the refrigeration cycle apparatus 1 performs, according to difference between suction temperature or refrigerant temperature of the indoor unit 3 and a set temperature for each room, temperature control by controlling opening degree of a flow control valve of the indoor unit 3 not shown in the figure or the frequency of the compressor 4, to circulate the certain amount of the refrigerant from the outdoor unit 2 to the indoor unit 3.

Next, the cooling operation in the refrigeration cycle apparatus 1 will be described. The solid arrow shown in FIG. 1 indicates a flow of the refrigerant during the cooling operation of the refrigeration cycle apparatus 1. Also, normal cooling operation rather than a capacity control state is in a state where the first solenoid valve 12 is opened and the second solenoid valve 13 is closed.

During the cooling operation, the refrigerant flows in a direction of the arrow shown by the solid line in FIG. 1. In this case, the four-way valve 5 connects the discharge side (high pressure side) of the compressor 4 to the gas side of the outdoor heat exchanger 6 and connects the gas connection pipe 29 to the suction side (low pressure side) of the compressor 4.

The gas refrigerant that is compressed by the compressor 4 and discharged into the pipe 20 passes the four-way valve 5 and flows into the outdoor heat exchanger 6 through the pipe 23. The gas refrigerant flown into the outdoor heat exchanger 6 releases condensation latent heat with a fan not shown in the figure to liquefy and the condensed liquid refrigerant passes through the outdoor expansion valve 7 and flows through the pipe 24.

Then, the liquid refrigerant flowing through the pipe 24 branches off at an upstream of the subcooler 8. One branched liquid refrigerant flows toward the liquid blocking valve 11, and other liquid refrigerant flows into the pipe 26 and flows toward the bypass expansion valve 14.

The liquid refrigerant flowing towards the liquid blocking valve 11 passes through the subcooler 8 to become a subcooled state and is then sent to the indoor unit 3 through the liquid connection pipe 28 via the liquid blocking valve 11. In the indoor unit 3, the liquid refrigerant is depressurized by the indoor expansion valve 30 and becomes a gas-liquid two-phase state with low temperature, which evaporates at the indoor heat exchanger 17. By absorbing heat to the extent of an amount of evaporation latent heat of the liquid refrigerant at the indoor heat exchanger 17, from ambient air sent by a fan not shown in the figure to the indoor heat exchanger 17, cold air is sent to each room and cooling operation is performed.

On the other hand, other branched liquid refrigerant is depressurized by the bypass expansion valve 14 and flows into the subcooler 8. In the subcooler 8, the liquid refrigerant is subjected to heat-exchange with a liquid refrigerant flowing from the outdoor expansion valve 7 to the liquid blocking valve 11, evaporates to become a gas refrigerant, which is gas-injected to the compressor 4 through the pipe 25 and the first solenoid valve 12. In such a manner, the refrigerant is kept at a predetermined superheat degree before and after the subcooler 8 and is injected under the gas state into the compression room 4*c* of the compressor 4 through the flow in/out port 4*d*. Thereby, circulation volume of the refrigerant at the discharge side of the compressor 4 is increased and a specific enthalpy at an inlet of an evaporator is reduced so that the cooling capacity increases.

Subsequently, the heating operation in the refrigeration cycle apparatus 1 will be described. The dashed arrow shown in FIG. 1 indicates the flow of the refrigerant during the heating operation of the refrigeration cycle apparatus 1. High-load or normal heating operation is in a state where the first solenoid valve 12 is opened and the second solenoid valve 13 is closed.

During the heating operation, the refrigerant flows in a direction of the arrow shown by the dashed line in FIG. 1.

In this case, the four-way valve 5 connects the discharge side (the high pressure side) of the compressor 4 to the gas connection pipe 29 and connects the gas side of the outdoor heat exchanger 6 to the suction side (the low pressure side) of the compressor 4.

The gas refrigerant compressed by the compressor 4 and discharged into the pipe 20 passes the four-way valve 5 and is sent to the indoor unit 3 by the gas connection pipe 29 through the gas blocking valve 10.

In the indoor unit 3, as the gas refrigerant condenses in the indoor heat exchanger 17 to release the condensation latent heat of the refrigerant, warm air is sent to each room and the heating operation is performed. The condensed liquid refrigerant passes through the liquid connection pipe 28 and flows into the outdoor unit 2 through the liquid blocking valve 11.

The liquid refrigerant returned to the outdoor unit 2 flows through the pipe 24, passes through the subcooler 8 and branches off at a downstream of the subcooler 8. One branched liquid refrigerant flows to the outdoor heat exchanger 6 and the other liquid refrigerant flows into the pipe 26 to flow toward the bypass expansion valve 14.

The liquid refrigerant flowing towards the outdoor heat exchanger 6 is depressurized according to an optional throttle amount of the outdoor expansion valve 7 and becomes gas-liquid two-phase state with low temperature, which evaporates at the outdoor heat exchanger 6. The evaporated gas refrigerant goes through the pipe 23, the four-way valve 5 and the pipe 21 and is adjusted to an appropriate suction dryness at the accumulator 9 and then returns to the suction side of the compressor 4.

On the other hand, other branched liquid refrigerant is depressurized by the bypass expansion valve 14 and flows into the subcooler 8. In the subcooler 8, the liquid refrigerant is subjected to heat-exchange with a liquid refrigerant flowing to the outdoor expansion valve 7 from the liquid blocking valve 11 and evaporates to become a gas refrigerant, which goes through the pipe 25 and the first solenoid valve 12 and is gas-injected into the compression room 4*c* of the compressor 4 through the flow in/out port 4*d*.

By performing the gas injection as set forth, it is possible that only the circulation volume of the refrigerant from the intermediate pressure to the discharge increases while keeping the circulation volume from the suction of the compressor 4 to the intermediate pressure. Consequently, as shown by the line A in FIG. 3, since subcooling effect is obtained at the subcooler 8, a capacity increases larger than a power increase is obtained. Since the economizer cycle is capable of leading the capacity increase at the rated capacity or the maximum capacity to reduction of the rotation speed of the compressor 4, when relatively large capacity is generated, power saving may be attained. On the other hand, generation capacity of the refrigeration cycle apparatus 1 is known to have long time so-called partial load operation (low-load operation) in which the capacity is relatively low, and in a conventional refrigeration cycle apparatus having an economizer cycle, with respect to power saving in such a state, sufficient consideration has not been paid.

Therefore, in the refrigeration cycle apparatus 1 according to the present embodiment, during the partial load operation a bypass operation described below is performed. The bypass operation is performed during the partial load operation in the cooling operation and the heating operation. During the bypass operation, the first solenoid valve 12 and the second solenoid valve 13 are opened and the bypass expansion valve 14 is closed.

Since the first solenoid valve 12 and the second solenoid valve 13 are opened and the pipe 21 is located at a lower pressure side, a part of the refrigerant compressed in the compression room 4*c* of the compressor 4 flows out from the flow in/out port 4*d* and flows toward the pipe 25. The refrigerant flown into the pipe 25 flows into the pipe 27 through the first solenoid valve 12, and flows into the pipe 21 through the second solenoid valve 13. In such a manner, the refrigerant under intermediate pressure in the process of the compression is bypassed to the lower pressure side of the compressor 4.

Thereby, becoming a refrigeration cycle shown by the line B in FIG. 3, the amount of the refrigerant discharged into the pipe 20 from the compressor 4 decreases so that the circulation volume of the refrigerant decreases and the capacity becomes low. A loss of the compression power corresponding to the circulation volume of the bypassed refrigerant may be reduced when compared with bypassing the refrigerant compressed to the high pressure.

Accordingly, since the minimum capacity is capable of being reduced in the case where the required capacity is low, a power loss due to intermittent operations of the compressor 4 may be suppressed and there is no reduction in COP (Coefficient of Performance: Cooling and heating average energy consumption efficiency) such that APF (Annual Performance Factor: Year-round energy consumption efficiency) may further be improved.

The timing for switching between the gas injection operation and the bypass operation is preferably to be no more than ½ of the maximum frequency of the rotation speed of the compressor 4 or a timing where a ratio of suction pressure (Ps) and discharge pressure (Pd) of the compressor 4 (the pressure ratio: Pd/Ps) is not more than 1.8.

According to the aforementioned refrigeration cycle apparatus 1, it is equipped with the compressor 4 having the flow in/out port 4*d* through which the refrigerant is capable of flowing out and flowing in, in fluid communication with the compression room 4*c*; the pipes 21, 22 disposed at the suction side of the compressor 4; the pipe 25 connected to the flow in/out port 4*d* of the compressor 4; the pipe 27 having one end connected to the pipe 25 and an opposite end connected to the pipe 21; and the second solenoid valve 13 for opening and closing the fluid passage of the pipe 27.

According to such a construction, by making the second solenoid valve 13 open or a close state where backward flow is allowed, a part of the refrigerant compressed at the compression room 4*c* of the compressor 4 flows toward the pipe 25 through the flow in/out port 4*d*. Then, the refrigerant flown into the first pipe 25 flows into the pipe 21 through the pipe 27 and the second solenoid valve 13 that is in the open state. In such a way, the refrigerant under the intermediate pressure in the process of the compression can be bypassed to the low pressure side of the compressor 4.

Thereby, since the amount of the refrigerant discharged into the pipe 20 from the compressor 4 decreases, the circulation volume of the refrigerant decreases and the capacity decreases. The loss of the compression power corresponding to the circulation volume of the bypassed refrigerant may be reduced in comparison with bypassing the refrigerant compressed to the high pressure. Accordingly, since the minimum capacity is capable of being reduced in the case where the required capacity is low, the power loss due to the intermittent operations of the compressor 4 may be suppressed and there is no reduction in COP such that APF may be further improved.

Also, since the first solenoid valve 12 for opening and closing the fluid passage of the pipe 25 is disposed, the liquid injection to the compressor 4 may be prevented by closing it under a condition that the refrigerant state transiently causes a large change such as when starting, stopping or defrosting and the like and the failure of the compressor 4 due to poor lubrication and liquid compression caused by the large amount of the liquid returned to the compressor 4 may be prevented to ensure the reliability.

Furthermore, in the case that the first solenoid valve 12 has a feature allowing backward flow in a state where it is closed and a back pressure is applied, regulation of the backward bypass flow rate becomes possible depending on the necessity.

Also, the pipe 24 for flowing the liquid refrigerant between the outdoor heat exchanger 6 and the indoor heat exchanger 17; the pipe 26 branched from the pipe 24 and connected to the pipe 25 and the pipe 27; the subcooler 8 for performing heat exchange between the refrigerant flowing through the pipe 26 and the refrigerant flowing through the pipe 24 and the bypass expansion valve 14 that depressurizes the refrigerant flowing through the pipe 26 are disposed.

In such a construction, by performing the gas injection to the compressor 4, it is possible that only the circulation volume of the refrigerant from the intermediate pressure to the discharge increase s while keeping the circulation volume to the intermediate pressure from the suction of the compressor 4. Consequently, since the subcooling effect is obtained at the subcooler 8, a capacity increase larger than a power increase is obtained. Since the economizer cycle is capable of leading the capacity increase at the rated capacity or the maximum capacity to reduction of the rotation speed of the compressor 4, power saving may be attained when relatively large capacity is generated.

Also, since the flow in/out port 4*d* is formed so as to open in a position after formation of the compression room 4*c* and before discharge of the refrigerant in the compression room from the discharge port, it is possible to reduce the loss of the compression power due to the bypass of the refrigerant.

Also, the compressor 4 is equipped with the release port 4*f* formed so as to open in a position where the refrigerant in the compression room 4*c* becomes higher pressure than that at the position where the flow in/out port 4*d* is formed, and the release port 4*f* is equipped with a release valve 4G for discharging the refrigerant from the compression room 4*c* when pressure in the compression room 4*c* becomes higher than the discharge pressure.

Accordingly, as shown by the compression process shown in FIGS. 7-12, it is possible to reduce over-compression loss during low pressure ratio operation, which occurs in a low-load operation where pressure inside the compression room becomes higher than the discharge pressure so that the efficiency of the compressor 4 may further improved.

Figure 7:
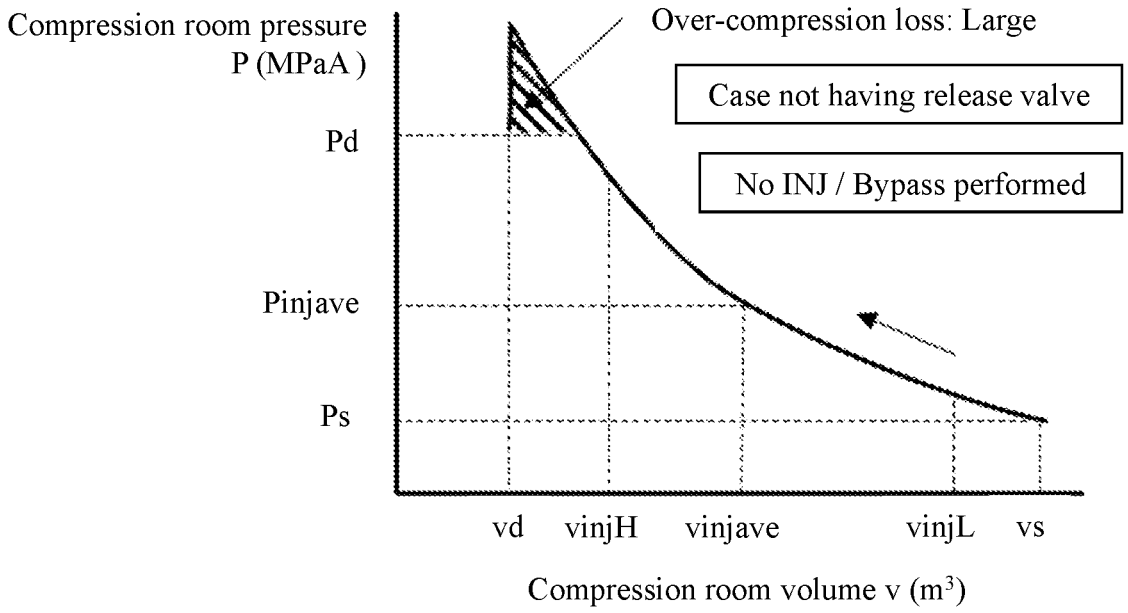
FIG. 7 shows a p-v diagram (a relationship between pressure and volume) showing compression process with no release valve.
Figure 8:
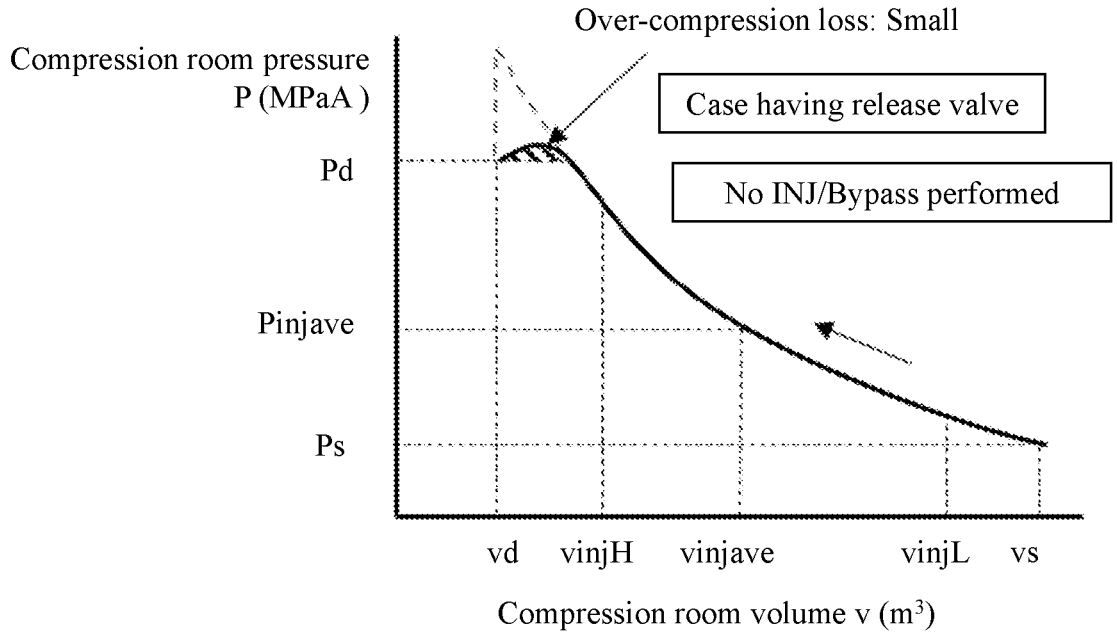
FIG. 8 shows a p-v diagram showing compression process with a release valve.

More specifically, FIG. 7 and FIG. 8 show operation conditions where there is no injection action and the load and the pressure ratio are low, and it is understood that the over-compression loss in the case having the release valve (FIG. 8) is reduced when compared to the case not having the release valve (FIG. 7).

Figure 9:
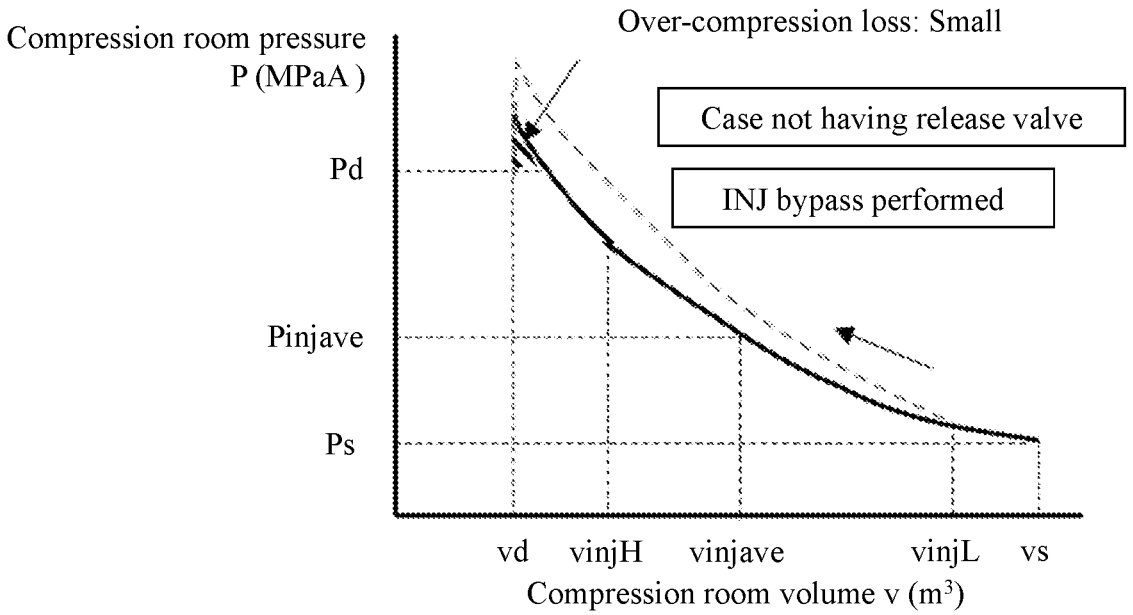
FIG. 9 shows a p-v diagram during INJ bypass operation with no release valve.
Figure 10:
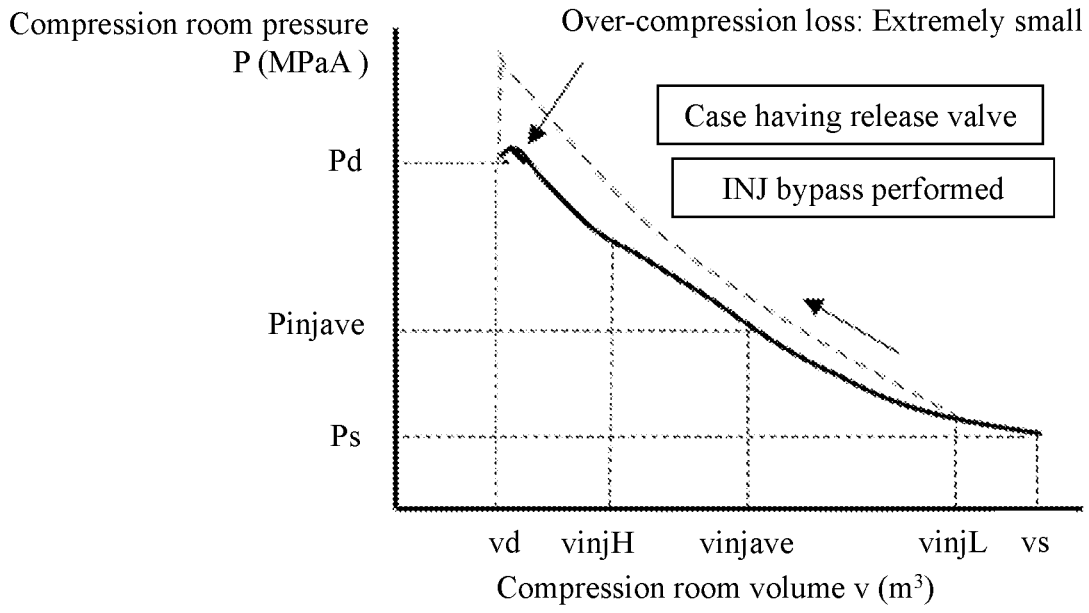
FIG. 10 shows a p-v diagram during INJ bypass operation with a release valve.

The conditions shown in FIG. 9 and FIG. 10 correspond to the cases where the bypassing from the injection port 4*d* is performed and the over-compression in the compression room 4*c* is suppressed and is further reduced cooperatively in combination with the release valve so that the efficiency reduction is further suppressed.

Figure 11:
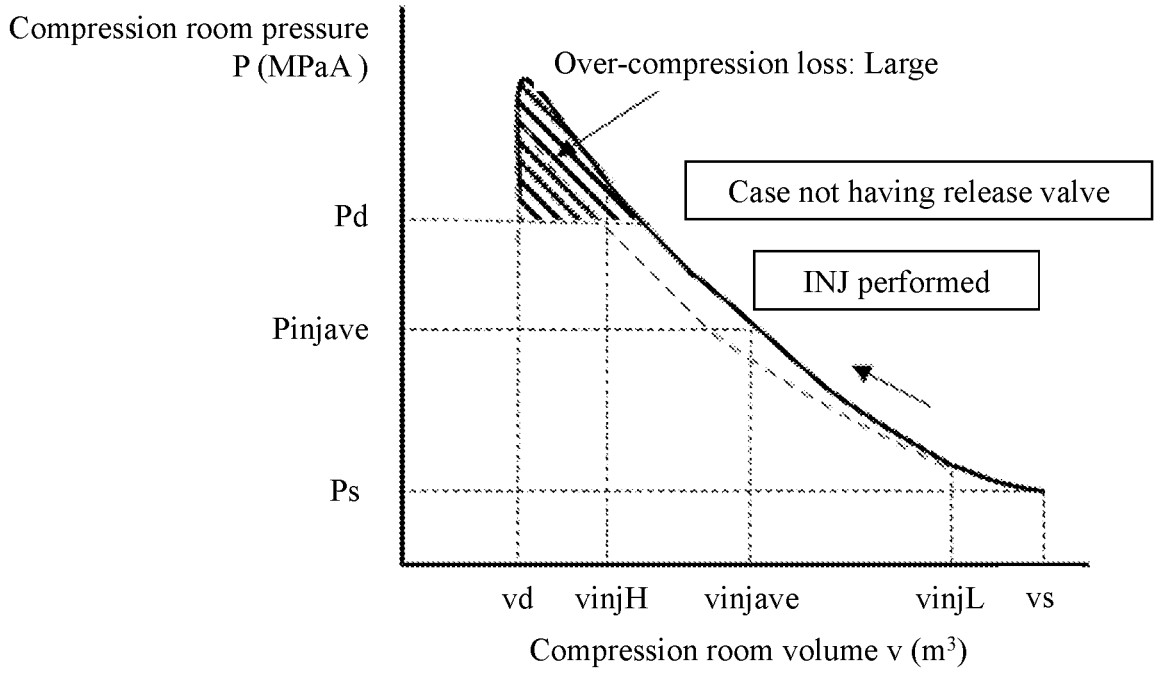
FIG. 11 shows a p-v diagram during INJ operation with no release valve.
Figure 12:
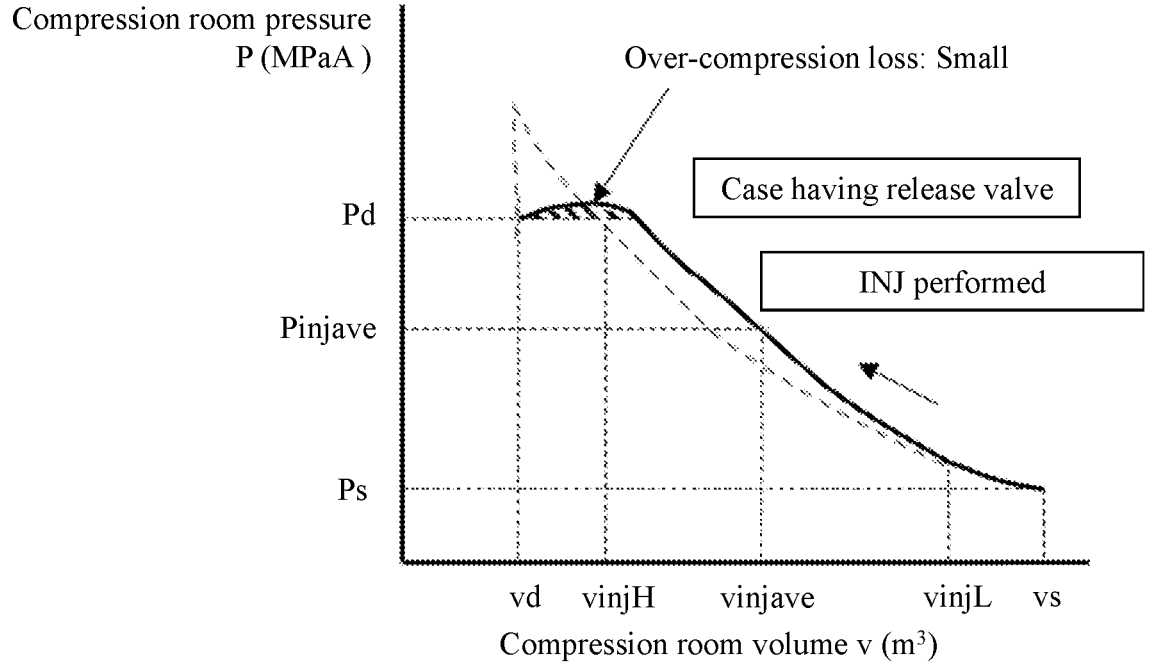
FIG. 12 shows a p-v diagram during INJ operation with a release valve.

The conditions shown in FIG. 11 and FIG. 12 correspond to the cases where the gas injection is performed, since the internal pressure rises due to the injection flow rate, the over-compression loss becomes large in the case not having the release valve of FIG. 11, but it is possible to reduce it in the case with the release valve.

In FIGS. 7-12, Pinjave, vinjave vinjH and vinjL represent injection average pressure, volume of the injection average pressure part, volume at which the injection port is closed, and volume at which the injection port is opened, respectively.

Furthermore, a silencer 16 is disposed to the pipe 25 between the flow in/out port 4*d* and the first solenoid valve 12. The structure of the silencer 16 is a container with a constant volume and is connected to two pipes of an inlet and an outlet. In the container, by attenuating pressure pulsation of the compressor 4 from the flow in/out port 4*d*, damage of the first solenoid valve 12 due to chattering of an internal valve body caused by pulsation of the circuit may be prevented.

Also, in the case that the rotation speed of the compressor 4 is not more than ½ of its maximum frequency, the controller 15 makes the first solenoid valve 12 and the second solenoid valve 13 open or an bypass flow regulating state if the first solenoid valve 12 is a solenoid valve that allows backward flow when it is closed, and flows the refrigerant from the compressor 4 into the pipe 25 and the pipe 27.

Figure 4:
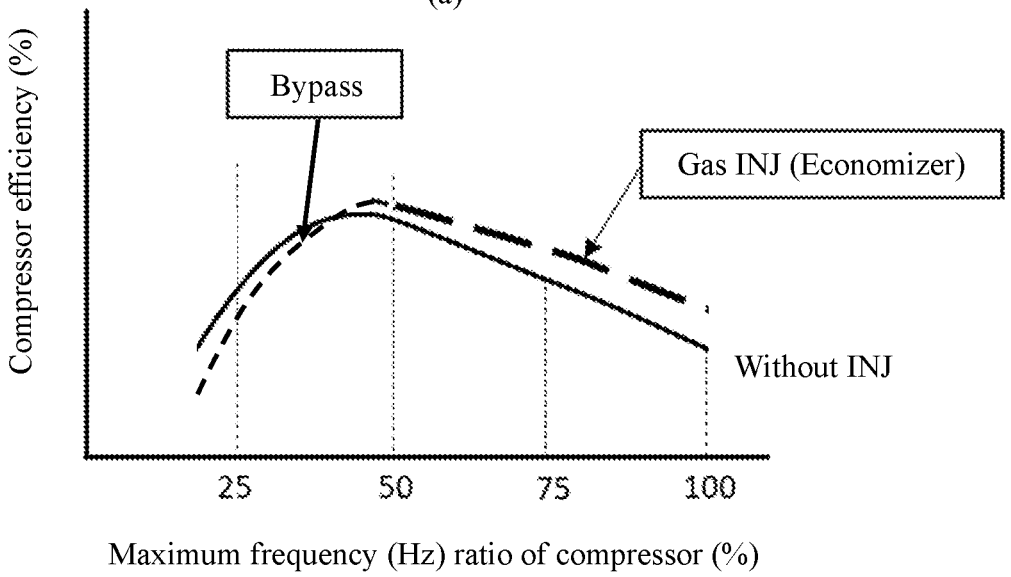
FIG. 4(*a*) shows a relationship between maximum frequency ratio of the compressor (%) and compressor efficiency (%) and FIG. 4(*b*) shows a relationship between rated capacity ratio (%) and compressor efficiency (%).
Figure 4:
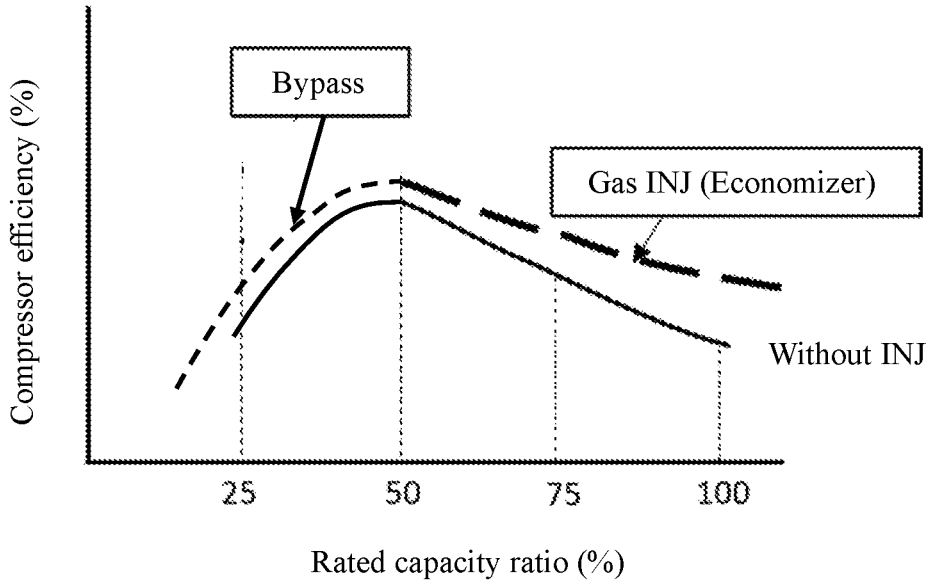

FIG. 4(*a*) shows a relationship between the maximum frequency ratio of the compressor (%) and compressor efficiency (%) and FIG. 4(*b*) shows a relationship between a rated capacity ratio (%) and the compressor efficiency (%).

In the case where the maximum frequency ratio is not more than 50%, by switching from the gas injection to the bypass operation, though the compression efficiency decreases under the same rotation ratio as show in FIG. 4(*a*), the compressor efficiency when compered at the same capacity is improved as show in FIG. 4(*b*).

The reason is that since the capacity decreases according to the bypassing, it is possible to avoid operation at a low-speed side where efficiency tends to decrease easily by increasing the rotation speed of the compressor with the same capacity. Specifically, since ratios of various losses such as a leak loss in the compression room 4*c* inside the compressor 4, a motor loss, an inverter loss and the like tends to increase at the vicinity of the minimum frequency, efficiency improvement due to the backward flow bypass from the injection port according to the present embodiment, in which it can operate without lowering the rotation speed too much, are effective.

Figure 6:
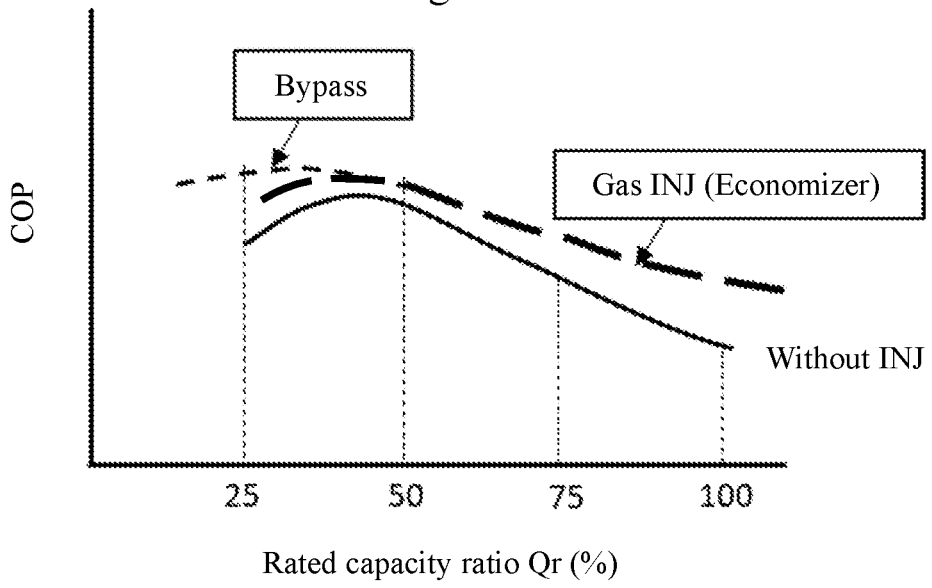
FIG. 6 shows a relationship between rated capacity ratio (%) and COP.

Furthermore, as shown in FIG. 6 using COP, i.e., the efficiency of the air conditioner, the capacity decrease leads to an efficiency improvement of the heat exchanger so that the compressor efficiency at a low load region before gas injection may be improved and the high capacity region may be extended.

Furthermore, in the case that the ratio of the suction pressure and the discharge pressure of the compressor 4 (Pd/Ps) is not more than 1.8, the controller 15 may make the first solenoid valve 12 and the second solenoid valve 13 open so as to flow the refrigerant from the compressor 4 to the pipe 25 and the pipe 27.

Figure 5:
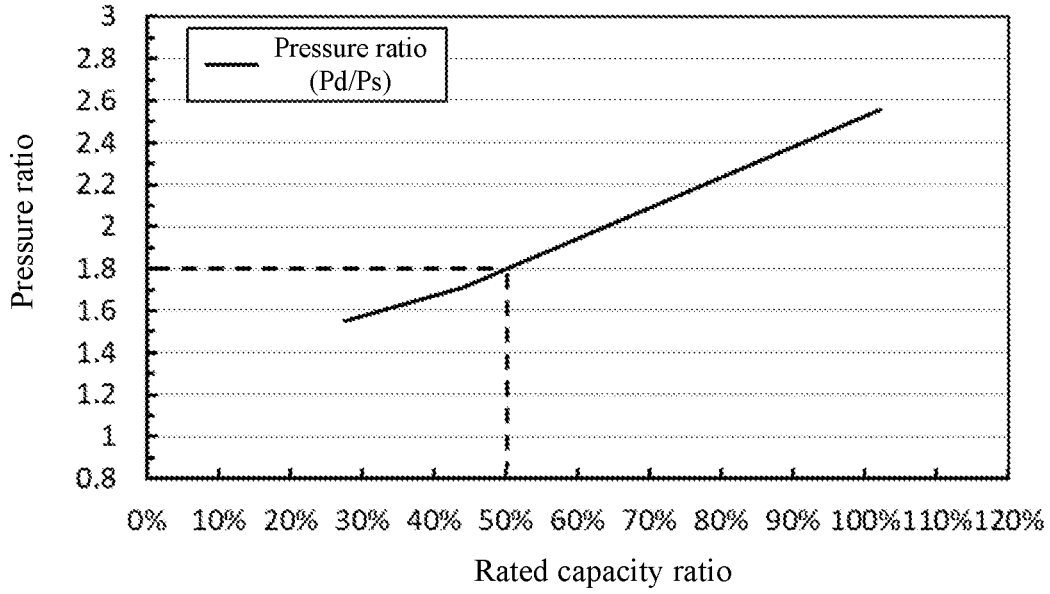
FIG. 5 shows a relationship between rated capacity ratio (%) and pressure ratio (Pd/Ps).

FIG. 5 shows a relationship between the rated capacity ratio (%) and the pressure ratio (Pd/Ps). FIG. 6 shows a relationship between the rated capacity ratio (%) and COP.

As shown in FIG. 5, the rated capacity ratio becomes 50% at a pressure ratio of 1.8. Also, as shown in FIG. 6, by switching from the injection to the bypass operation at the rated capacity ratio not more than 50%, COP at a low load region before the gas injection may be improved while COP at a high-capacity region may be improved by switching to the gas injection, thereby resulting in a COP improvement over an entire region.

The present embodiment is not limited to the aforementioned examples. Those of ordinary skill in the art can make various additions, modifications and the like within the scope of the present embodiments.

For example, the first solenoid valve 12 may be a valve with a bleed port (micro channel) By providing the bleed port, it is possible to set the bypass flow rate to a predetermined appropriate rate by keeping the first solenoid valve 12 closed and also to improve the efficiency at the low-load region appropriately.

Also, the first solenoid valve 12 may be an expansion valve. By being an expansion valve, the bypass flow rate may be regulated to an appropriate flow rate and the efficiency at the low-load region may be improved appropriately.

Furthermore, though the aforementioned refrigeration cycle apparatus 1 is equipped with the first solenoid valve 12, the first solenoid valve 12 may be omitted. Also, the pipe 27 is connected to the pipe 21, but it may be connected to the pipe 22.

REFERENCE SIGNS LIST

1: refrigeration cycle apparatus; 2: outdoor unit; 3: indoor unit; 4: compressor; 4*c*: compression room; 4*d*: flow in/out port; 4*f*: release port; 4G: release valve; 6: outdoor heat exchanger; 8: subcooler; 12: first solenoid valve; 13: second solenoid valve; 14: bypass expansion valve; 15: controller; 16: silencer; 17: indoor heat exchanger; 21, 22: pipes (suction side pipe); 25: pipe (first pipe); 26: pipe (third pipe); 27: pipe (second pipe).

The invention claimed is:

1. A refrigeration cycle apparatus, comprising:

a compressor having a port allowing a refrigerant to flow out, in fluid communication with a compression room;

a suction side pipe disposed at a suction side of the compressor;

a first pipe connected to the port of the compressor;

a second pipe having one end connected to the first pipe and an opposite end connected to the suction side pipe;

a second pipe on-off valve for opening and closing a fluid passage of the second pipe;

a first pipe on-off valve for opening and closing a fluid passage of the first pipe; and a controller configured to:

open the first pipe on-off valve and the second pipe on-off valve so as to flow a refrigerant from the compressor to the first pipe and the second pipe in a case that a rotation speed of the compressor is not more than ½ of a maximum frequency of the rotation speed of the compressor or in a case that a ratio of suction pressure and discharge pressure of the compressor (the discharge pressure/the suction pressure) is not more than 1.8, wherein the first pipe on-off valve comprises a bleed port.

2. The refrigeration cycle apparatus of claim 1, wherein the refrigeration cycle apparatus comprises:

a liquid pipe for flowing a liquid refrigerant between an outdoor heat exchanger and an indoor heat exchanger;

a third pipe branched from the liquid pipe and connected to the first pipe and the second pipe;

a subcooler for performing heat exchange between a refrigerant flowing through the third pipe and a refrigerant flowing through the liquid pipe; and an expansion valve for depressurizing a refrigerant flowing through the third pipe.

3. The refrigeration cycle apparatus of claim 1, wherein the first pipe on-off valve is a solenoid valve.

4. The refrigeration cycle apparatus of claim 1, wherein the port is formed so as to open in a position after formation of the compression room and before discharge of a refrigerant in the compression room from the discharge port.

5. The refrigeration cycle apparatus of claim 1, wherein the first pipe is disposed with a silencer between the port and the first pipe on-off valve.

6. A refrigeration cycle apparatus, comprising:

a compressor having a port allowing a refrigerant to flow out, in fluid communication with a compression room;

a suction side pipe disposed at a suction side of the compressor;

a first pipe connected to the port of the compressor;

a second pipe having one end connected to the first pipe and an opposite end connected to the suction side pipe;

a second pipe on-off valve for opening and closing a fluid passage of the second pipe;

a first pipe on-off valve for opening and closing a fluid passage of the first pipe; and a controller configured to:

open the first pipe on-off valve and the second pipe on-off valve so as to flow a refrigerant from the compressor to the first pipe and the second pipe in a case that a rotation speed of the compressor is not more than ½ of a maximum frequency of the rotation speed of the compressor or in a case that a ratio of suction pressure and discharge pressure of the compressor (the discharge pressure/the suction pressure) is not more than 1.8, wherein the port is formed so as to open in a position after formation of the compression room and before discharge of a refrigerant in the compression room from the discharge port, and wherein a release port is disposed to the compressor and the release port is formed at a position providing higher pressure of a refrigerant in the compression room than that at a position of the port formed, the release port being equipped with a release valve for discharging a refrigerant from the compression room when pressure in the compression room becomes higher than a predetermined pressure.

* * * * *